US006579191B1

(12) United States Patent
Hambly

(10) Patent No.: US 6,579,191 B1
(45) Date of Patent: Jun. 17, 2003

(54) LASER PUTTER DEVICE

(76) Inventor: Todd E. Hambly, 174 Beverly Dr., Barnegat, NJ (US) 08005

( * ) Notice: Subject to any disclaimer, the term of this patent is extended or adjusted under 35 U.S.C. 154(b) by 0 days.

(21) Appl. No.: 09/993,078

(22) Filed: Nov. 13, 2001

(51) Int. Cl.[7] ..... A63B 67/62; A63B 69/36; A63B 57/00

(52) U.S. Cl. ..... 473/151; 473/140; 473/145

(58) Field of Search ..... 473/140–149, 473/151–155, 173, 176, 180, 190, 192, 200, 220–225; 273/371; 73/379.5, 379.4

(56) References Cited

U.S. PATENT DOCUMENTS

| | | | | | |
|---|---|---|---|---|---|
| 628,236 | A | * | 7/1899 | Warren | 73/379.05 |
| 1,680,897 | A | * | 8/1928 | Matteson, Jr. | 73/379.04 |
| 1,857,588 | A | * | 5/1932 | Doll | 473/146 |
| 3,020,049 | A | * | 2/1962 | McNeill | 473/140 |
| 3,601,408 | A | * | 8/1971 | Wright | 473/225 |
| 3,870,314 | A | * | 3/1975 | Bertucci | 473/141 |
| 4,848,769 | A | * | 7/1989 | Bell et al. | 473/140 |
| 5,042,814 | A | * | 8/1991 | Bennett | 473/225 |
| 5,324,039 | A | * | 6/1994 | Reimers et al. | 473/180 |
| 5,330,188 | A | * | 7/1994 | Reimers | 473/151 |
| 5,527,041 | A | | 6/1996 | Terry, III et al. | |
| 5,818,036 | A | | 10/1998 | Daly | |
| 6,036,608 | A | | 3/2000 | Morris | |
| 6,213,887 | B1 | | 4/2001 | Carney | |
| 6,425,830 | B1 | * | 7/2002 | Chou | 473/140 |

* cited by examiner

*Primary Examiner*—Paul T. Sewell
*Assistant Examiner*—Alvin A. Hunter
(74) *Attorney, Agent, or Firm*—Sturm & Fix LLP

(57) ABSTRACT

The present invention entails a laser guided golf putting system. A laser is mounted into a golf ball mechanism. The golf ball mechanism is comprised of a golf ball mounted on a shaft and supported by a support ball. When a golfer strikes the golf ball, the ball, securely connected to the shaft, falls forward. When the ball falls forward, the laser mounted in the golf ball mechanism shines forward and indicates on a target where the golf ball is projected to go. The laser is activated when the golf ball mechanism is in the fallen position, and deactivated when the golf ball mechanism is upright and ready for a golfer to strike.

18 Claims, 7 Drawing Sheets

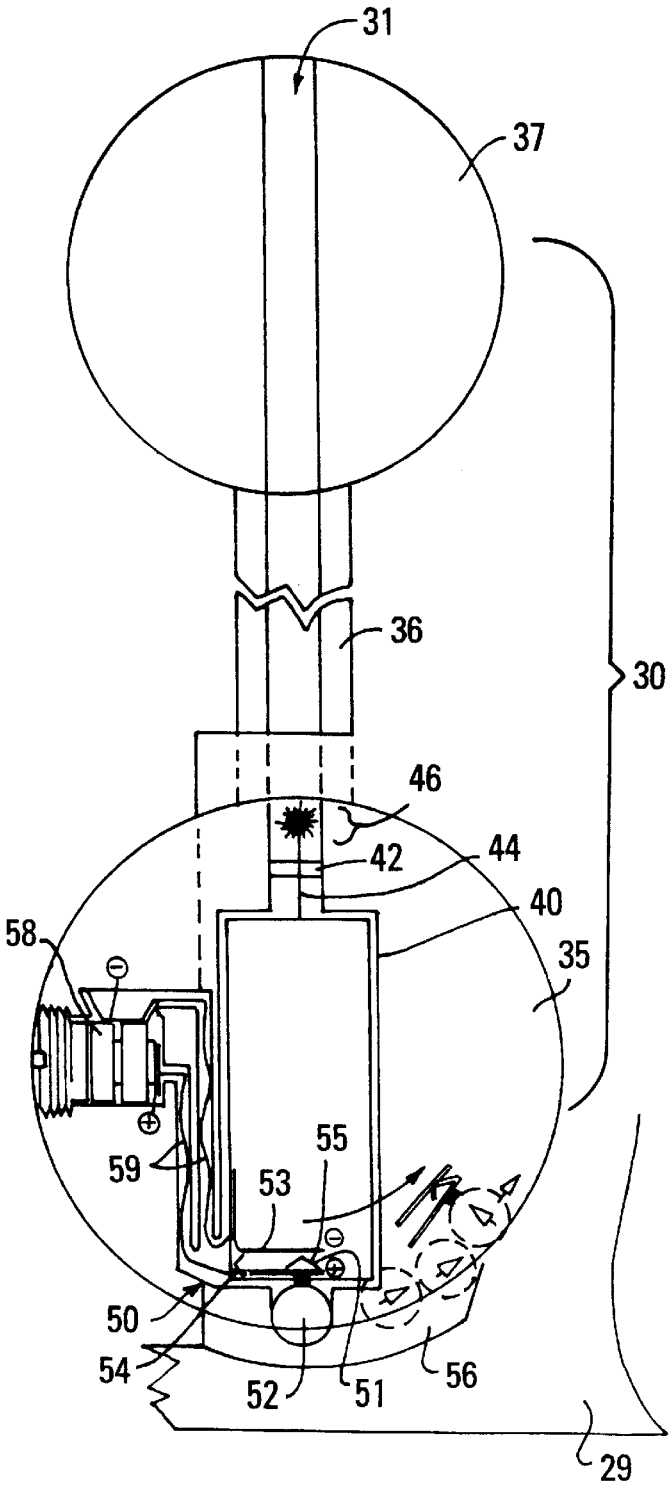
Fig. 3
Fig. 4
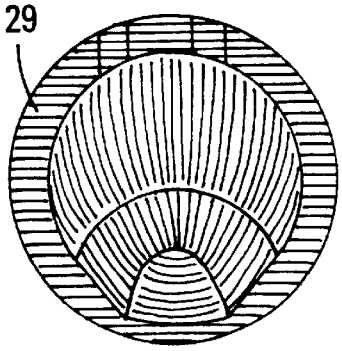
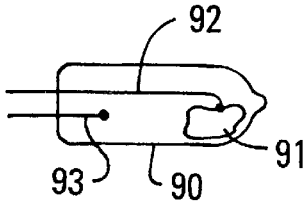
Fig. 5

LASER PUTTER DEVICE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

1. Field of the Invention

This present invention relates to the field of golf putting practice systems, and more particularly to golf putting practice systems that use a laser to indicate accuracy.

2. Description of the Related Art

Laser guided golf putting practice systems are well known in the art. Typical laser guided golf putting systems use an external laser to trace a path for the golfer to aim towards. Typical golf putting practice systems do not place an internal laser into a golf ball mechanism to track where the golf ball would go after striking by a golfer. As can be seen by reference to the following U.S. Pat. Nos. 6,213,887B1, and 5,818,036, the prior art is replete with laser guided golf practice systems. U.S. Pat. No. 6,213,887B1, titled "Apparatus for Practicing the Game of Golf," is an invention designed to use a laser to aid in practicing golf putting, but the invention is distinguished from the present invention by the use of a mounted laser outside the golf ball to provide an illuminated reference for putting a golf ball. In addition, U.S. Pat. No. 5,818,036 also titled "Laser Aided Practice Putting Device and Method," is also an invention designed to provide laser guided assistance to a golfer practicing putting golf balls, but it also entails a mounted laser outside of the golf ball to provide an illuminated reference for putting a golf ball.

While all of the aforementioned prior art constructions are more than adequate for the basic purpose and function for which they have been specifically designed, they are uniformly deficient with respect to their failure to provide a simple, efficient and practical laser guided system with a laser mounted in a golf ball mechanism to indicate the projected movement of the golf ball after a golfer strikes the golf ball. As a consequence of the foregoing situation, there has existed a longstanding need for a new and improved laser putter device, and the provision of such a construction is a stated objective of the present invention.

BRIEF SUMMARY OF THE INVENTION

The invention is a device for practicing putting a golf ball. The invention includes a golf ball mechanism comprised of a golf ball, connected by a shaft to a support ball such that the golf ball when hit pivots down into a fallen position. A laser is mounted in the golf ball mechanism such that when the golf ball mechanism is in the fallen position, the laser illuminates forward to indicate the direction the golf ball would move if the golf ball was not connected to the shaft. Targets are optionally set up such that the laser from the golf ball shines onto the targets to indicate whether a target was hit. The laser optionally contains a lens insert such that the light pattern proceeding from the laser is in the shape of a golf ball. The laser is deactivated when the golf ball mechanism is upright and ready for a golfer to strike. This prevents the laser from shining directly into the eyes of a golfer. The laser is then activated when a golfer strikes the golf ball, and the golf ball mechanism proceeds into a fallen position, with the laser shining onto a target.

BRIEF DESCRIPTION OF THE SEVERAL VIEWS OF THE DRAWING

These and other attributes of the invention will become more clear upon a thorough study of the following description of the best mode for carrying out the invention, particularly when reviewed in conjunction with the drawings, wherein:

FIG. 3 is a sectional view of the support ball;

FIG. 4 is a sectional view of the socket;

FIG. 5 is a side elevational view of a mercury switch;

DETAILED DESCRIPTION OF THE BEST MODE

Figure 1:
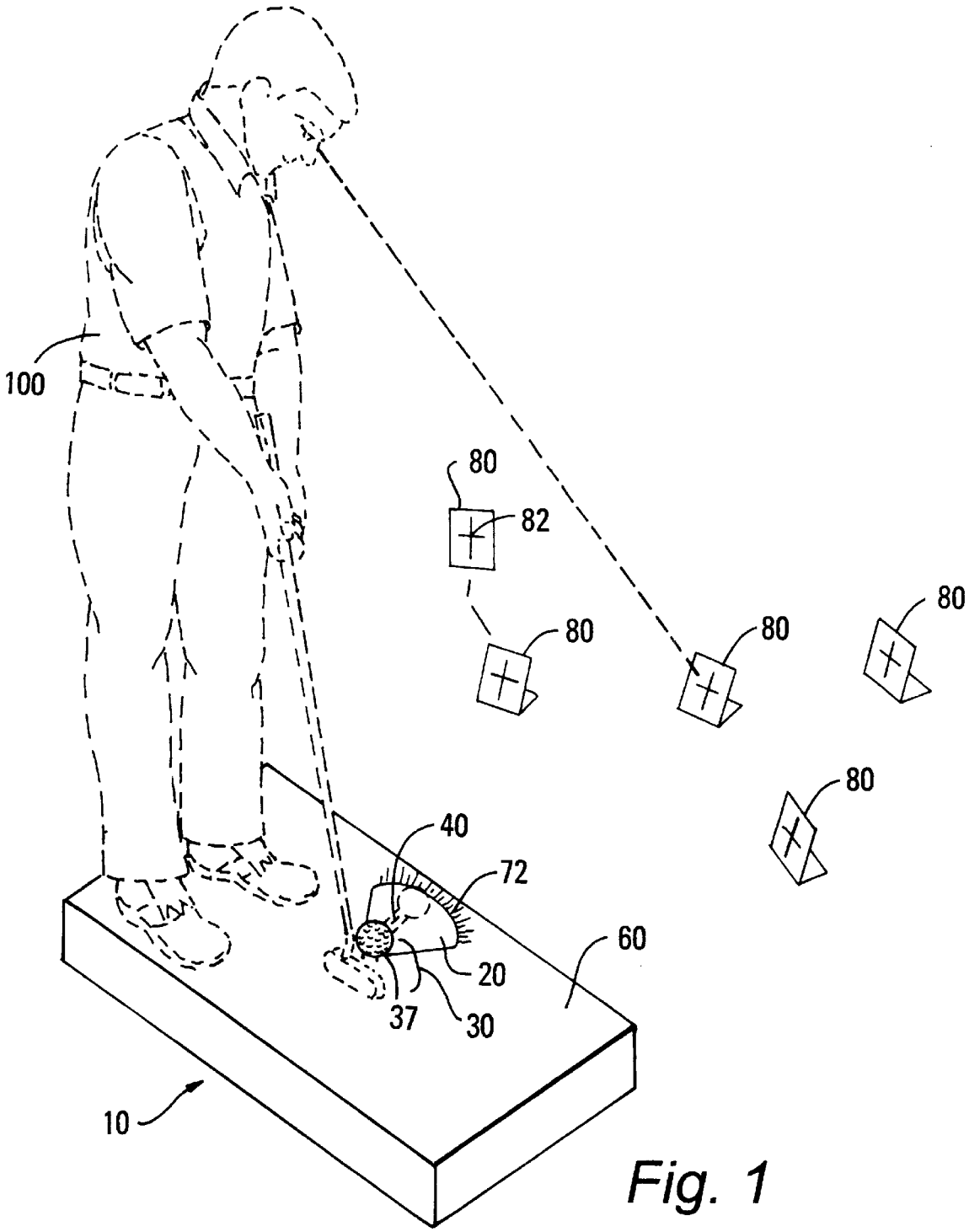
FIG. 1 is a perspective view of a golfer using an embodiment of the present invention.
Figure 2:
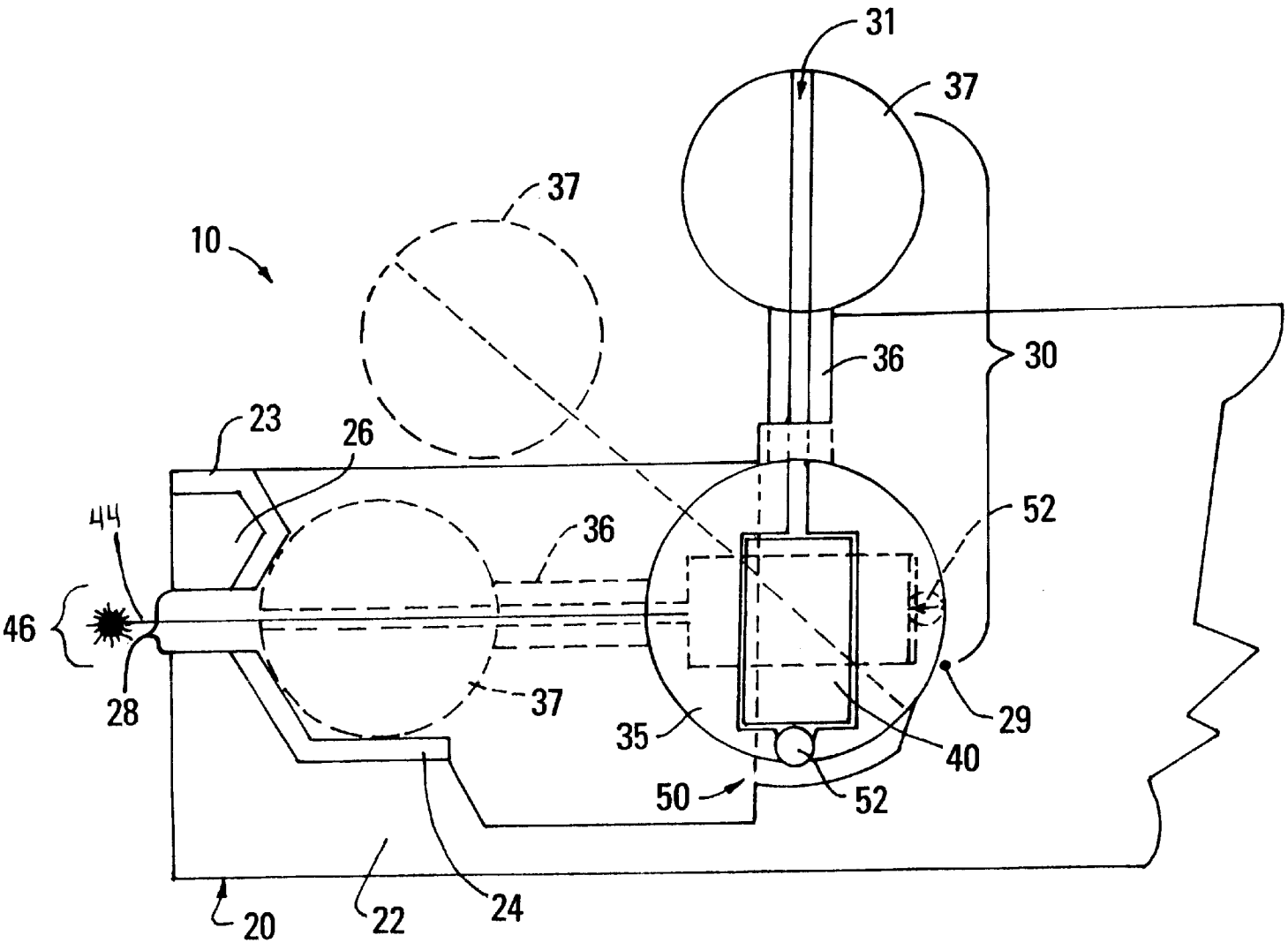
FIG. 2 is a side elevational view of the golf ball mechanism in the fallen position and the upright positions.

As can be seen by reference to the drawings, and particular to FIG. 1, the laser putter device that forms the basis of the present invention is designated generally by the reference number 10. As seen in FIG. 2, the laser putter is comprised of a base 20, a golf ball mechanism 30, a laser device 40, and a laser actuator device 50. The base 20 is comprised of a frame 22, a stop cushion 24, a retainer 26 alone the periphery of the base 20, a beam exit-slit 28 along the periphery of the base 20 between the stop cushion 24 and the retainer 26, and a socket 29. The frame 22 supports the other members of the base 20. The stop cushion 24 is comprised of material such as, for example, foam rubber, for cushioning the fall of the golf ball mechanism 30, with a minimum of bouncing or rebounding off of the stop cushion 24.

The retainer 26 is mounted on the periphery of the base 20 in such a way that it traps the golf ball mechanism 30 when the golf ball mechanism 30 is in the fallen position. One embodiment of the retainer 26 is a rubber wedge 23 angled to trap the golf ball mechanism 30 when in the fallen position. As shown in FIGS. 7–11, another embodiment is a rubber flap 25 positioned to trap the golf ball mechanism 30, such that the flap 25 flexibly moves to allow the downward movement of the golf ball mechanism 30, but returns to its original position, and traps the golf ball mechanism 30 in the fallen position. This trapping or freezing of the golf ball mechanism 30 prevents excessive bouncing and rebounding of the golf ball mechanism 30 off of the stop cushion 24.

Figure 6:
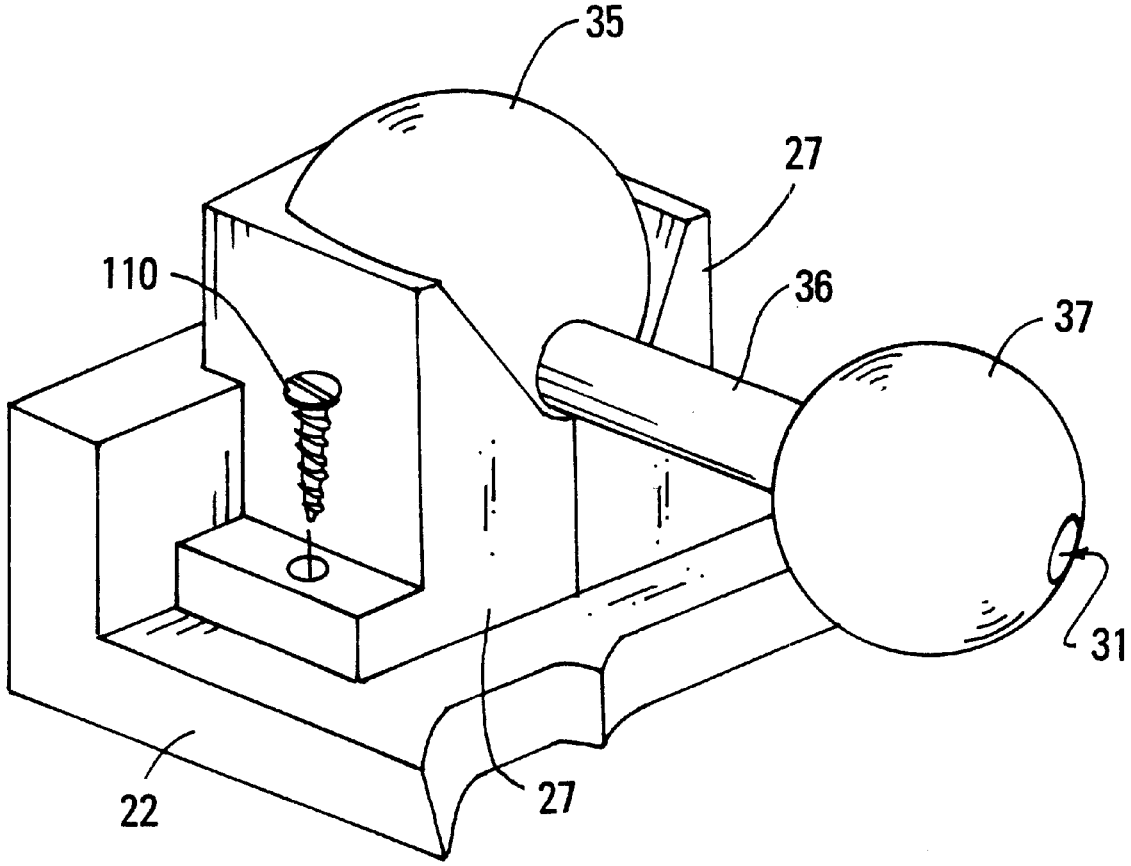
FIG. 6 is a perspective view of an embodiment of the base and golf ball mechanism.
Figure 7:
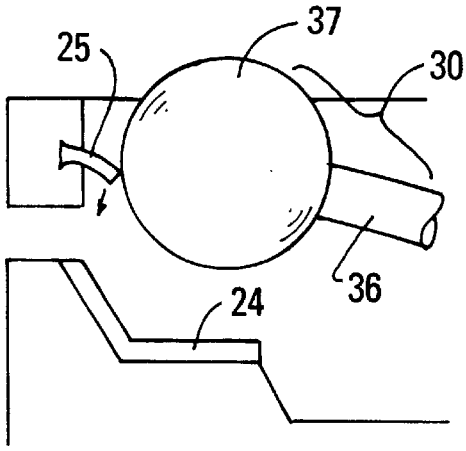
FIG. 7 is a side elevational view of the golf ball mechanism approaching a fallen position.
Figure 9:
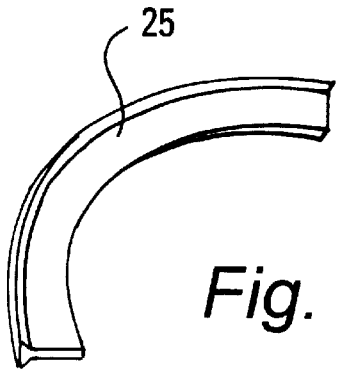
FIG. 9 is a perspective view of the retainer on the base.
Figure 8:
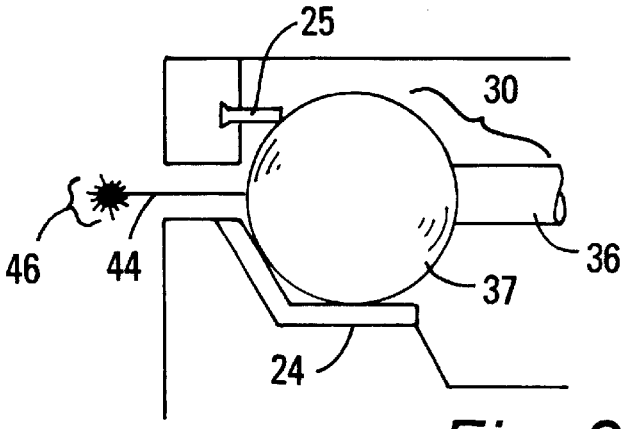
FIG. 8 is a side elevational view of an embodiment of the present invention in the fallen position.
Figure 10:
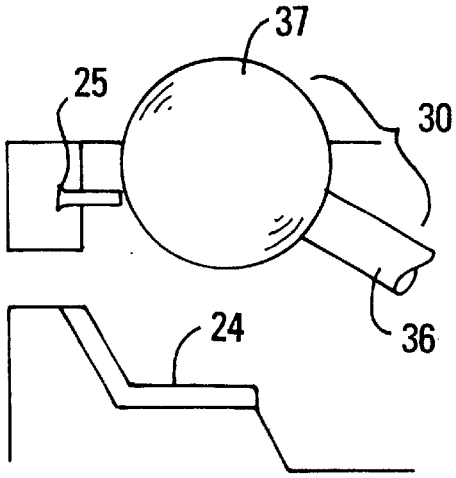
FIG. 10 is a side elevational view of the golf ball mechanism approaching a fallen position.
Figure 11:
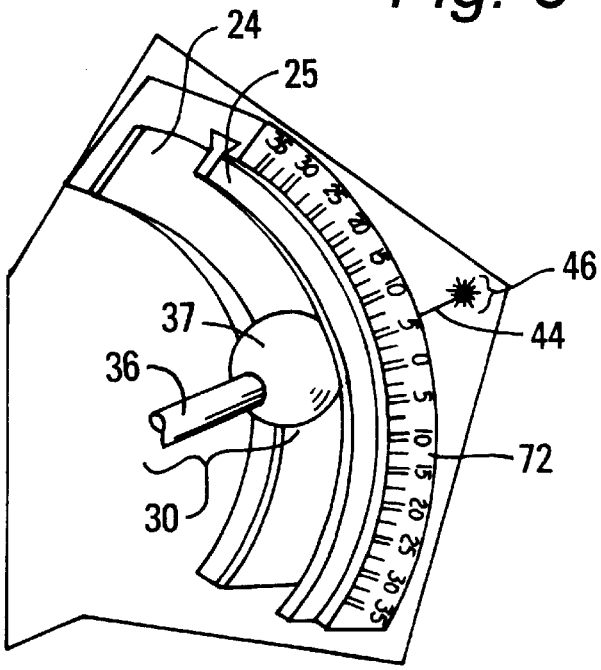
FIG. 11 is a plan view of an embodiment of the present invention in the fallen position.

As shown in FIG. 2, the beam exit-slit 28 is an opening between the retainer 26 and the stop cushion 24. The beam exit-slit opening 28 is along the periphery of the base 20, through which a laser beam 44 may be directed. The socket 29 in the base 20 is the socket end of a ball-and-socket connection. The support ball 35 of the golf ball mechanism 30 is connected to the socket 29. FIG. 4 shows a sectional view of the socket 29. As shown in FIG. 6, the socket 29 is optionally comprised of symmetrical halves 27 joined together with screws 110.

Figure 12:
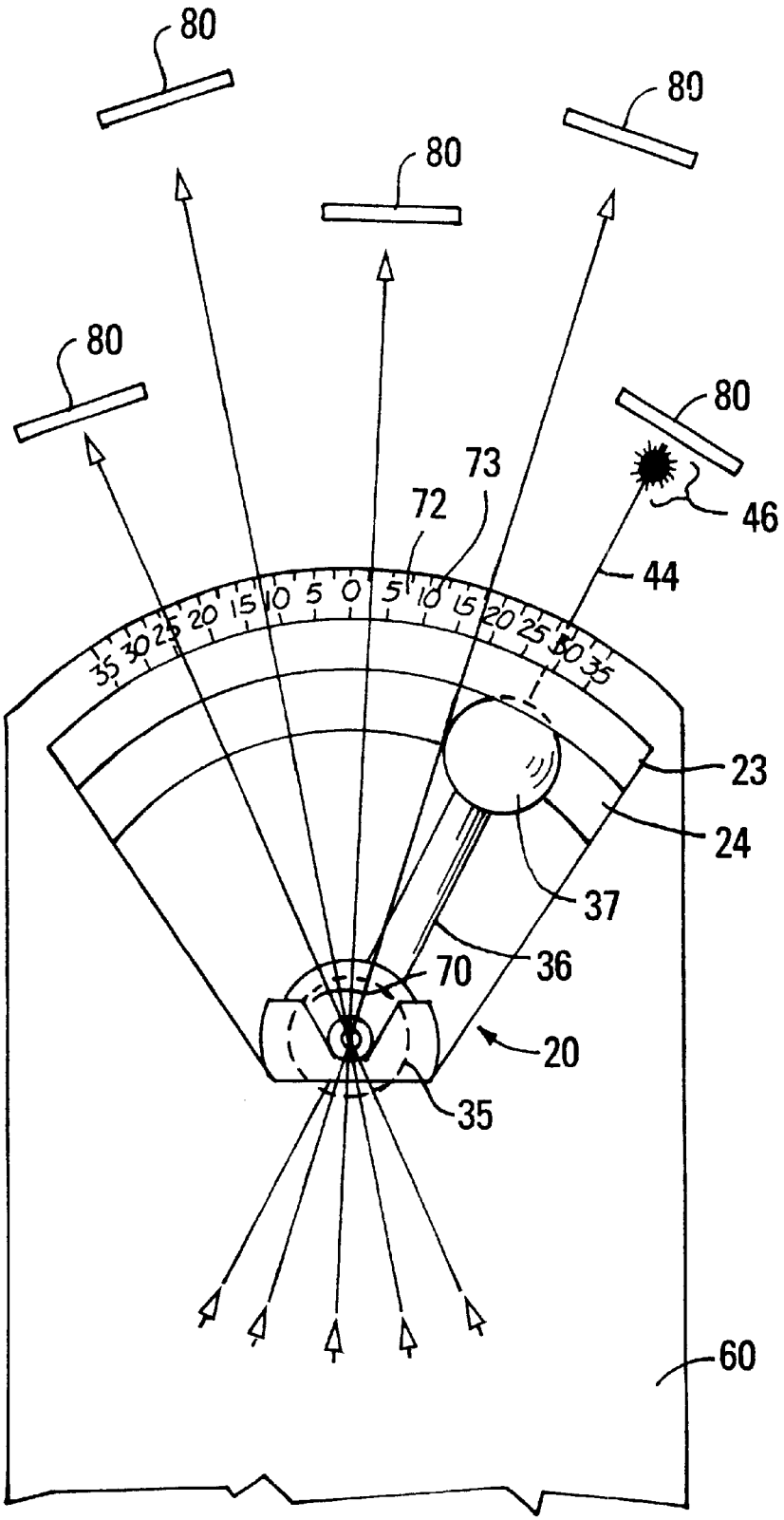
FIG. 12 is a plan view of an embodiment of the present invention with targets positioned in front of the present invention.

In one embodiment, as shown in FIG. 1, an optionally detachable platform 60 is mounted beneath the base 20. The platform 60 may be made of lightweight materials such as molded plastic, and patterns such as a honeycomb pattern or any corrugation type pattern suitable for weight bearing purposes. The platform 60 is wide enough for a person 100 to stand on the platform 60 on either side of the base 20, thus providing for both left-handed and right-handed golfers. The platform 60 may also have a layer of artificial turf for golfers' shoes to grip while using the laser putter device 10. Additionally, as shown in FIG. 12, a relief notch 70 opening may be in the socket 29 attached to the base 20 on the platform 60 as a guide for allowable putting angles between, for example, 35 degrees to the left or the right of center 74. A protractor 72 with visible markings for angle degrees 73 may also be added to the base 20 for aiding in putting, and aiding in setting up targets 80.

As shown in FIG. 2, the golf ball mechanism 30 is comprised of a support ball 35, a shaft 36, and a golf ball 37. The support ball 35 and the golf ball 37 are attached to the shaft 36 at opposite ends of the shaft 36. A channel 31 runs through at least part of the support ball 35, completely through the shaft 36, and completely through the golf ball 37. The support ball 35 is pivotally received in the socket 29 on the base 20. The channel 31 through the support ball 35, shaft 36, and golf ball 37, are aligned such that the channel 31 through them comprises one continuous channel 31.

The golf ball mechanism 30 has a starting, upright position, and a fallen position. When the golf ball mechanism 30 is in the starting position, the golf ball mechanism 30 is upright, with the golf ball 37 on top of the support ball 35. The support ball 35 is on the bottom of the golf ball mechanism 30, and supports the shaft 36 and the golf ball 37. When the golf ball mechanism 30 is in the fallen position, the golf ball mechanism 30 rests horizontally against the base 20, with the channel 31 within the golf ball 37 forward and adjacent to the beam-exit slit 28. The shaft 36 then rests horizontally behind the golf ball 37, and the support ball 35 rests horizontally on the base 20 behind the shaft 36, with the support ball 35 remaining within the socket 29 on the base.

A laser 40 is disposed within the golf ball mechanism 30. In one embodiment of the invention 10, the laser 40 is a common laser pointer class laser. The laser 40 is disposed within the channel 31 in the golf ball mechanism 30. The laser 40 is disposed such that the light from the laser 40 shines outward through the channel 31 and out the beam exit-slit 28 on the base 20 when the golf ball mechanism 30 is in the fallen position. In one embodiment, as shown in FIG. 3, the laser 40 contains a detachable lens insert 42 such that when the laser 40 is activated, the laser 40 projects a golf ball image 46 on a target 80 (FIG. 12). In one embodiment, the lens insert 42 may be placed within the golf ball mechanism 30 in a threaded opening 43 in the golf ball mechanism 30. The lens insert 42 may contain a slotted screwdriver notch 45.

As shown in FIG. 3, a laser actuator 50 is disposed on the laser putter device 10 such that the laser 40 is turned off when the golf ball mechanism 30 is in the upright starting position, and the laser 40 is turned on when the golf ball mechanism 30 is in the fallen position. In one embodiment of the invention, the laser actuator 50 is comprised of a ball bearing 52, a contact switch 54, and a bearing relief notch 56. The ball bearing 52 is mounted on the support ball 35 adjacent to the contact switch 54. An embodiment of a contact switch 54 with a battery 58 and wires 59 is shown. When the golf ball mechanism 30 is in the upright starting position, the ball bearing 52 is adjacent to the bearing relief notch 56, and tends to fall away from the support ball 35. Therefore, the ball bearing 52 does not press against the contact switch 54, leaving the contact switch 54 in the open position 55, and the laser 40 is deactivated. When the golf ball mechanism 30 is in the fallen horizontal position, the ball bearing 52 is no longer adjacent to the bearing relief notch 56. Therefore, the socket 29 exerts pressure against the ball bearing 52, and the ball bearing 52 presses together the first end of the contact switch 51 against the second end of the contact switch 53, thereby activating the switch 54, and thereby activating the laser 40. As shown in FIG. 5, another embodiment entails the use of a mercury switch 90 to activate and deactivate the laser 40 (FIG. 3). The common mercury switch 90 is activated when liquid mercury 91 is in contact with a first wire 92 and a second wire 93, which would occur when the golf ball mechanism 30 (FIG. 3) is in the fallen position. The mercury switch 90 is deactivated when the liquid mercury 91 moves away from the second wire 93, which would occur when the golf ball mechanism 30 (FIG. 3) is in the upright starting position.

Figure 13:
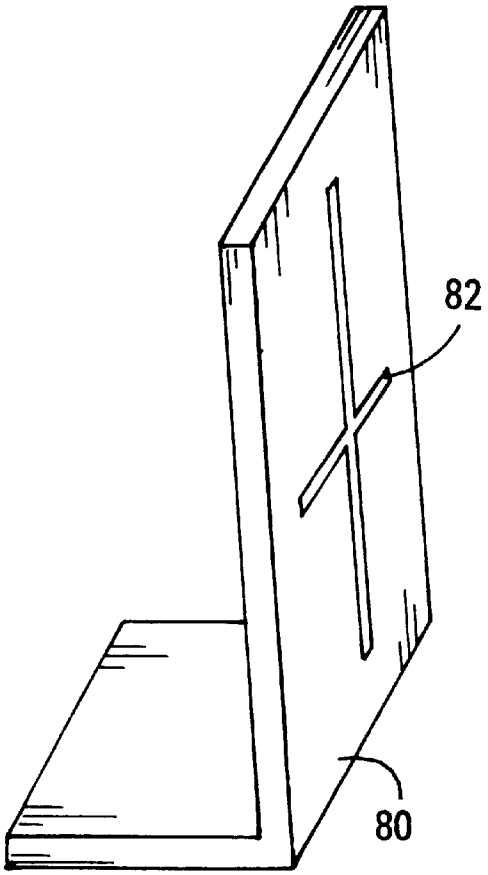
FIG. 13 is a perspective view of a target.
Figure 14:
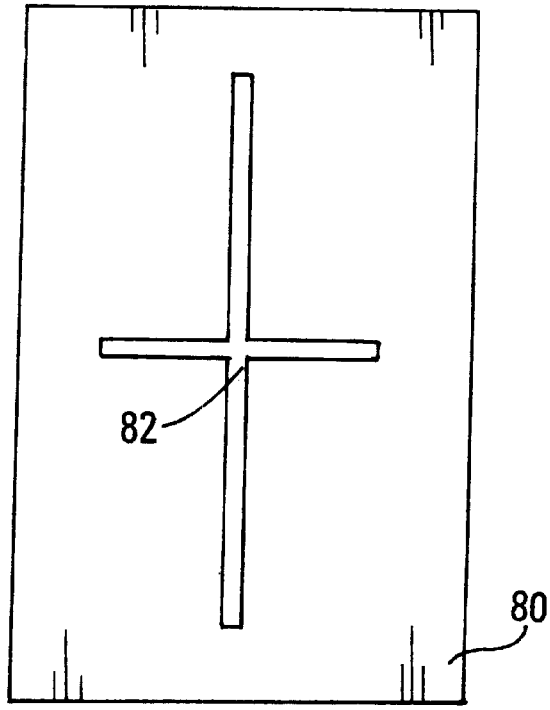
FIG. 14 is a front elevational view of a target.

As shown in FIG. 1, in one embodiment color-coded targets 80 with cross-hair 82 are positioned in front of the laser putter 10. The purpose of color-coding is for long distance distinction of the targets 80 and for two-party reference. As shown in FIGS. 13 and 14, the targets 80 may be plastic molded as one piece with, for example, an angle of 5 degrees from the target base to stabilize the target 80. Additional embodiments of the laser putter 10 are possible, such as hanging the laser putter 10 upside down, with the golf ball 37 still in position for striking by a golfer 100.

In use, a person using the present invention stands with a golf putter adjacent to the golf ball as shown in FIG. 1. The targets 80 are placed forward of the golf ball 37 at various angles, with the cross-hair 82 of the target 80 facing the laser putter device 10. The protractor 72 is used to help line up the targets 80 at various angles. After the targets 80 have been placed at the desired locations in front of the laser putter device 10, the user then aims the golf ball 37 at a target 80, and strikes the golf ball 37 toward the target 80.

The laser 40 mounted within the golf ball mechanism 30 activates when the golf ball mechanism 30 is in the fallen position. The laser beam 44 (FIG. 2) indicates whether the golf ball 37 was aimed correctly at a target 80 as a result of alignment of the support ball 35, shaft 36, and golf ball 37 within the golf ball mechanism 30. This indication by the laser beam 44 on a target 80 produces a visible cause-and-effect result of the golfer 100 striking the golf ball 37. The golfer 100 then proceeds to lift the golf ball mechanism 30 back into the upright starting position, and the laser actuator

50 (FIG. 2) deactivates the laser 40. This prevents the laser 40 from shining into the eyes of the golfer 100. The device 10 is usable by both left and right-handed golfers 100.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A laser putter device, comprising:

a base, including a frame;

a stop cushion disposed as a layer on the frame;

a retainer disposed above the stop cushion along the periphery of the frame;

a beam exit-slit disposed forward of and between the stop cushion and the retainer;

a socket disposed on the frame rearward of the stop cushion;

a golf ball mechanism, including a support ball pivotally received in the socket on the base, the support ball having a first channel formed therein, a shaft connected to the support ball, the shaft having a second channel formed there through, and being aligned with the first channel, and a golf ball attached to the shaft remote from the support ball, the golf ball having a third channel formed therethrough and being aligned with the first and second channels, the golf ball mechanism being movable between an upright starting position, wherein the golf ball is vertically positioned above the shaft and support ball, and a fallen ending position, wherein the golf ball is positioned horizontally forward from the shaft and support ball;

a laser emitter disposed within the golf ball mechanism to emit a laser beam outwardly through the channels, and outwardly through the exit-slit in the base when the golf ball mechanism is in the fallen position; and a laser actuator disposed such that the laser emitter is deactivated when the golf ball mechanism is in the starting position, and the laser emitter is activated when the golf ball mechanism is in the fallen position.

2. The laser putter of claim 1, wherein the retainer is a wedge made of rubber disposed along the periphery of the base, with the wedge positioned to trap the golf ball when the golf ball mechanism is in the fallen position.

3. The laser putter of claim 1, wherein the retainer is a rubber flap disposed along the periphery of the base, and disposed to trap the golf ball when the golf ball mechanism is in the fallen position.

4. The laser putter of claim 1, wherein the base is disposed in a platform having a sufficient width for left-handed or right-handed persons to stand on either side of the base.

5. The laser putter of claim 4, wherein the platform is a light-weight apparatus capable of withstanding the weight of a human being standing thereon.

6. The laser putter of claim 4, wherein the platform is constructed of a molded-plastic material.

7. The laser putter of claim 4, wherein the platform is detachable from the base.

8. The laser putter of claim 4, wherein the platform can be utilized on either side for either left-handed or right-handed golfers.

9. The laser putter of claim 1, wherein the laser contains a detachable lens insert such that when the laser is activated, the laser projects a golf ball-like image through the lens.

10. The laser putter of claim 1, wherein the laser actuator is a mercury switch for the activation and deactivation of the laser.

11. The laser putter of claim 1, wherein targets are set up at varied angles and distances from the laser putter.

12. The laser putter of claim 11, wherein the targets are made of plastic, and are molded as one piece.

13. The laser putter of claim 11, wherein the targets contain a cross-hair.

14. The laser putter of claim 11, wherein the targets are angled 5 degrees from an angle perpendicular to the target base, for stability of the target.

15. The laser putter of claim 11, wherein the targets are color-coded for the purpose of distinguishing the targets from each other.

16. The laser putter of claim 1, wherein the laser actuator includes:

a ball bearing protruding from the support ball;

a contact switch in contact with the ball bearing; and a ball bearing relief notch in the socket such that when the golf ball mechanism is in the starting position, the laser is deactivated, and the ball bearing is adjacent to the ball bearing relief notch, and when the golf ball mechanism is in the fallen position, the ball bearing is spaced from the ball bearing relief notch, such that the socket wall pushes the ball bearing against the contact switch, thereby activating the laser.

17. The laser putter of claim 1, wherein a protractor is disposed on the frontal periphery of the base for use as a visual aid during use of the laser putter.

18. The laser putter of claim 1, wherein the socket on the base is comprised of two symmetrical halves.

* * * * *